US006162999A

United States Patent [19]

Ishikawa et al.

[11] Patent Number: 6,162,999

[45] **Date of Patent: *Dec. 19, 2000**

[54] MULTI-DIRECTIONAL OPERATING SWITCH

[75] Inventors: Takayuki Ishikawa; Isao Nozoe, both of Tsuruga, Japan

[73] Assignee: Matsushita Electric Industrial Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/189,297

[22] Filed: Nov. 10, 1998

[30] Foreign Application Priority Data

Nov. 10, 1997 [JP] Japan ..... 9-306866

[51] Int. Cl.[7] ..... H01H 25/04

[52] U.S. Cl. ..... 200/6 A; 200/4; 200/339

[58] Field of Search ..... 200/4, 5 A, 5 R, 200/6 A, 8 R, 344, 345, 513, 517, 339

[56] References Cited

U.S. PATENT DOCUMENTS

| | | | |
|---|---|---|---|
| 4,614,847 | 9/1986 | Sasao et al. | 200/6 A |
| 4,687,200 | 8/1987 | Shirai | 273/148 B |
| 5,386,091 | 1/1995 | Clancy | 200/517 |
| 5,468,924 | 11/1995 | Naitou et al. | 200/6 A |
| 5,496,977 | 3/1996 | Date et al. | 200/6 A |
| 5,498,843 | 3/1996 | Date et al. | 200/6 A |
| 5,516,996 | 5/1996 | Shin | 200/345 |
| 5,525,770 | 6/1996 | Matsumiya et al. | 200/6 A |
| 5,555,004 | 9/1996 | Ono et al. | 345/161 |
| 5,564,560 | 10/1996 | Minelli et al. | 200/516 |
| 5,619,021 | 4/1997 | Yamamoto et al. | 200/6 A |
| 5,621,196 | 4/1997 | Nishijima et al. | 200/6 A |
| 5,691,517 | 11/1997 | Yamamoto et al. | 200/6 A |
| 5,744,765 | 4/1998 | Yamamoto | 200/6 A |

*Primary Examiner*—Renee Luebke
*Attorney, Agent, or Firm*—Rossi & Associates

[57] ABSTRACT

A multi-directional operating switch for use in various kinds of electronic equipment, and the switch comprises: an insulation substrate employing a plurality of stationary contacts on an upper surface thereof; an elastic contactor body disposed on the insulation substrate and having a plurality of domed portions, which is provided with movable contacts each confronting with the stationary contacts, on a lower surface at a center and outer periphery, and one of the domed portions at the center further having a hole in an upper surface; a manipulation body of which a tip of protuberant part at a lower center surface is press-fitted into the hole in the upper surface of the domed portion at the center of the elastic contactor body, and having a plurality of depressing limbs around the lower peripheral surface for depressing the domed portions at the outer periphery of the elastic contactor body when being tilted; and a case having an opening for a center area of the manipulation body to pass through, and for covering an upper surface of the manipulation body while maintaining a predetermined space in order to avoid said case from touching with the manipulation body when the manipulation body is in a neutral position and when it is tilted.

5 Claims, 7 Drawing Sheets

MULTI-DIRECTIONAL OPERATING SWITCH

FIELD OF THE INVENTION

The present invention relates to multi-directional operating switches for use in various kinds of electronic equipment.

BACKGROUND OF THE INVENTION

With an advancement of multifarious electronic equipment toward diversification and multifunction in late years, operating switches of multi-directional type, which combine a pushing manipulation and tilting manipulation, are increasingly being utilized.

A multi-directional operating switch of the prior art is described hereinafter by referring to FIG. 5 through FIG. 7.

FIG. 5 is a cross-sectional view showing the multi-directional operating switch of the prior art in a neutral position wherein no pushing manipulation is being made. In the figure, an insulation substrate 1 employs plural pairs of stationary contacts 2A, 2B, 2C, (and others not shown) on its upper surface, and an elastic contactor body 3 made of elastic rubber is disposed on the insulation substrate 1. The elastic contactor body 3 is formed at its center and a right, a left, a front and a rear sides with a plurality of domed portions 3A, 3B, 3C, (and others not shown, of which lower surfaces are provided with movable contacts 4A, 4B, 4C, (and others not shown) each facing against the stationary contacts 2A, 2B and 2C.

Also, the multi-directional operating switch of the prior art is equipped with a manipulation body 5 made of an insulating polymeric resin and a case 6 to cover the manipulation body 5 and the elastic contactor body 3. A protuberant part 5A at a lower center surface of the manipulation body 5 is inserted into a hole 3F in an upper center surface of the elastic contactor body 3. The manipulation body 5 is provided with depressing limbs 5B, 5C, (and others not shown) at the right, the left, the front and the rear sides of its lower surface above the domed portions 3B and 3C. A top center part 5F of the manipulation body 5 that protrudes from an opening 6A of the case 6 is attached with a discus-shaped knob 7, and a semispherical center area 5G at an upper surface of the manipulation body 5 is thrust upwardly by an elastic restorative force of the domed portion 3A to contact elastically against a lower peripheral surface of the opening 6A in the case 6.

In the above structure, when the knob 7 is subjected to a pushing manipulation by being pressed vertically downward from its neutral position in FIG. 5, the center area 5G of the manipulation body 5 departs from the lower peripheral surface of the opening 6A of the case 6 as shown in FIG. 6, and the protuberant part 5A inserted into the hole 3F in the elastic contactor body 3 depresses the domed portion 3A. The depressed domed portion 3A moves downward to cause the movable contact 4A at its lower surface to contact with the stationary contacts 2A, thereby making an electrical connection of the stationary contacts 2A. Subsequently, when a pushing force of the manipulation to the knob 7 is removed, the movable contact 4A at the lower surface separates from the stationary contacts 2A to disconnect them by the elastic restorative force of the domed portion 3A, and the manipulation body 5 and the knob 7 return to their original neutral positions as shown in FIG. 5.

Also, when a left edge of the knob 7 is subjected to a tilting manipulation by being pressed toward the left as shown in FIG. 7 from its neutral position in FIG. 5, the manipulation body 5 tilts toward the left with a tip of the protuberant part 5A as being a fulcrum while the semispherical center area 5G slides along the lower peripheral surface of the opening 6A of the case 6 as they maintain an elastic contact with each other, and a depressing limb 5B at a lower left end depresses a domed portion 3B. The depressed domed portion 3B moves downward to cause the movable contact 4B at its lower surface to contact with the stationary contacts 2B, thereby making an electrical connection of the stationary contacts 2B. And, when a force of the tilting manipulation to the left edge of the knob 7 is removed, the movable contact 4B at the lower surface separates from the stationary contacts 2B by the elastic restorative force of the domed portions 3B, and the manipulation body 5 and the knob 7 return to their original neutral positions in FIG. 5.

In the same manner as above, if the knob 7 is manipulated for tilting it either rightward, forward or backward from the neutral position of FIG. 5, the manipulation body 5 tilts rightward, forward or backward direction, and a depressing limb 5C at the lower surface depresses a domed portion 3C, 3D or 3E. The depressed domed portion 3C moves downward to make electrical connection of the stationary contacts 2C by a corresponding movable contact 4C at the lower surface respectively.

With the multi-directional operating switch of the prior art, however, there is a problem of causing a scraping feeling with regard to manipulatory feeling of the switch due to friction of the semispherical center area 5G at the upper surface of the manipulation body 5, since the semispherical center area 5G, which is thrust upwardly by the domed portions 3A at the center, slides elastically along the lower peripheral surface of the opening 6A of the case 6 when the knob 7 is subjected to the tilting manipulation rightward, leftward, forward or backward, or when it is returned to the neutral position.

SUMMARY OF THE INVENTION

It is an object of the present invention to provide multi-directional operating switches, which give a good manipulatory feeling at a low cost.

In order to achieve the above object, a multi-directional operating switch of the present invention comprises the following elements:

(a) an insulation substrate employing a plurality of stationary contacts on its upper surface;

(b) an elastic contactor body disposed on the insulation substrate and having a plurality of domed portions, which is provided with movable contacts each facing against the stationary contacts, on the lower surface at a center and outer periphery, and one of the domed portions at the center further having a hole in the upper surface;

(c) a manipulation body, of which a tip of protuberant part at its lower center surface is press-fitted into the hole in the upper surface of the domed portion at the center of the elastic contactor body, and having a plurality of depressing limbs around the lower peripheral surface for depressing the domed portions at the outer periphery of the elastic contactor body when being tilted; and (d) a case having an opening for a center area of the manipulation body to protrude therethrough, and for covering an upper surface of the manipulation body while maintaining a predetermined space in order to avoid the case from touching with the manipulation body when it is in the neutral position and when it is tilted.

Since the tip end of the protuberant part at lower center surface of the manipulation body is held by press-fitting to the hole in the upper surface of the domed located in the center portion at the center of the elastic contactor body for being movable in up and down motion as well as in tilting motion, and a predetermined space is provided between the manipulation body and the case for covering the manipulation body in order to avoid the manipulation body from touching with the case when it is in the neutral position as well as when it is tilted, so that the multi-directional operating switch having a satisfactory feeling of manipulation without causing a friction and a feel of scraping is obtained at a low cost.

Also, since the multi-directional operating switch of the present invention comprises the case provided with a projection at its lower surface for pressing the elastic contactor body at periphery of the domed portion against the insulation substrate, the periphery of the domed portion is held by the projection under the case so as not to lift up from the insulation substrate when the domed portion is moved downwardly for making and breaking contact with the stationary contacts, thereby attaining a stable and reliable movement of the domed portion and a distinctly good feeling of manipulation.

Moreover, the multi-directional operating switch of the present invention comprises a plate-shaped knob mounted on a top center part of the manipulation body for covering a substantial portion of an upper area of the opening of the case so that a space, which is provided between the manipulation body and the case in order to prevent the manipulation body from touching to the case, is substantially sheltered with the plate-shaped knob, thereby maintaining dust-tightness of the switch.

Furthermore, the multi-directional operating switch of the present invention comprises at least one self-contained unitary push switch disposed on the insulation substrate, and a depressing face for activating the push switch is arranged in place of the movable contact at the lower surface of the domed portion of the elastic contactor body corresponding to the push switch, so as to differentiate a feel of the pushing manipulation from that of the tilting manipulation with the self-contained unitary push switch which provides a distinctive feel of manipulation such as a clicking instead of a domed portion at the center or at the periphery of the elastic contactor body. Since a push switch of various kinds having different number of circuits, operating force, etc. is disposable without requiring any alteration of other parts, a multi-directional operating switch having numerous operational functions is readily obtainable.

DESCRIPTION OF THE PREFERRED EMBODIMENTS

Figure 1:
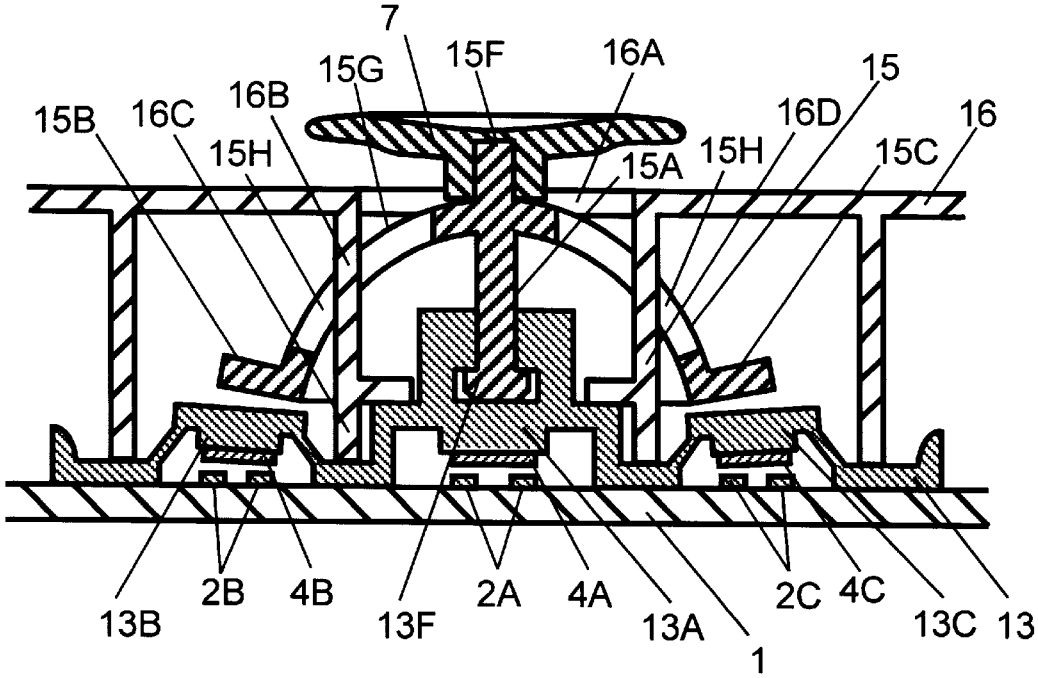
FIG. 1 is a cross sectional view showing a multi-directional operating switch of a first exemplary embodiment of the present invention in its neutral position.

Preferred embodiments of the present invention are described hereinafter by referring to FIG. 1 through FIG. 4. Here, any elements that have the same structure as those already described in the previous section for the prior art will be assigned with the same reference numerals and detailed description will be omitted.

FIRST EXEMPLARY EMBODIMENT

A multi-directional operating switch of a first exemplary embodiment of the present invention will be described by referring to FIG. 1 through FIG. 3.

An insulation substrate 1 employs plural pairs of stationary contacts 2A, 2B, 2C, (and others not shown) on its upper surface. An elastic contactor body 13 is made of elastic rubber, which is disposed on the insulation substrate 1, and is formed with a plurality of domed portions 13A, 13B, 13C, (and others not shown), of which lower surface is provided with movable contacts 4A, 4B, 4C, (and others not shown) confronting with each of the stationary contacts 2A, 2B and 2C, respectively at the center, right, left, front and rear sides of the elastic contactor body 13.

A case 16 covers a manipulation body 15 made of an insulating polymeric resin and the elastic contactor body 13. A protuberant part 15A at a lower center surface of the manipulation body 15 is inserted into a hole 13F in the upper surface of the domed portion 13A at the center of the elastic contactor body 13 in such a manner that a slightly enlarged tip of the protuberant part 15A is press-fitted in a deep of the hole 13F, so that the manipulation body 15 is held by the elastic contactor body 13 for being movable in up and down motion as well as in tilting motion. A lower surface of the manipulation body 15 is provided with depressing limbs 15B, 15C, (and others not shown) at the right, left, front and rear sides above the domed portions 13B and 13C.

The case 16 has an opening 16A and a peripheral wall 16B around the periphery of the opening 16A. A plate-shaped knob, preferably discus-shaped knob 7 is attached at a top center part 15F of the manipulation body 15 that protrudes through the opening 16A of the case 16 for covering a substantial portion of an upper surface of the opening 16A. There is a predetermined space between a semispherical center area 15G at an upper surface of the manipulation body 15 and the peripheral wall 16B around the opening 16A of the case 16. The case 16 is also provided with projections 16C and 16D at a lower position of the opening 16A. These projections 16C and 16D hold the elastic contactor body 13 against the insulation substrate 1 by pressing a periphery of the domed portion 13A at the center of the elastic contactor body 13 by passing through openings 15H furnished in the semispherical center area 15G of the manipulation body 15.

Figure 2:
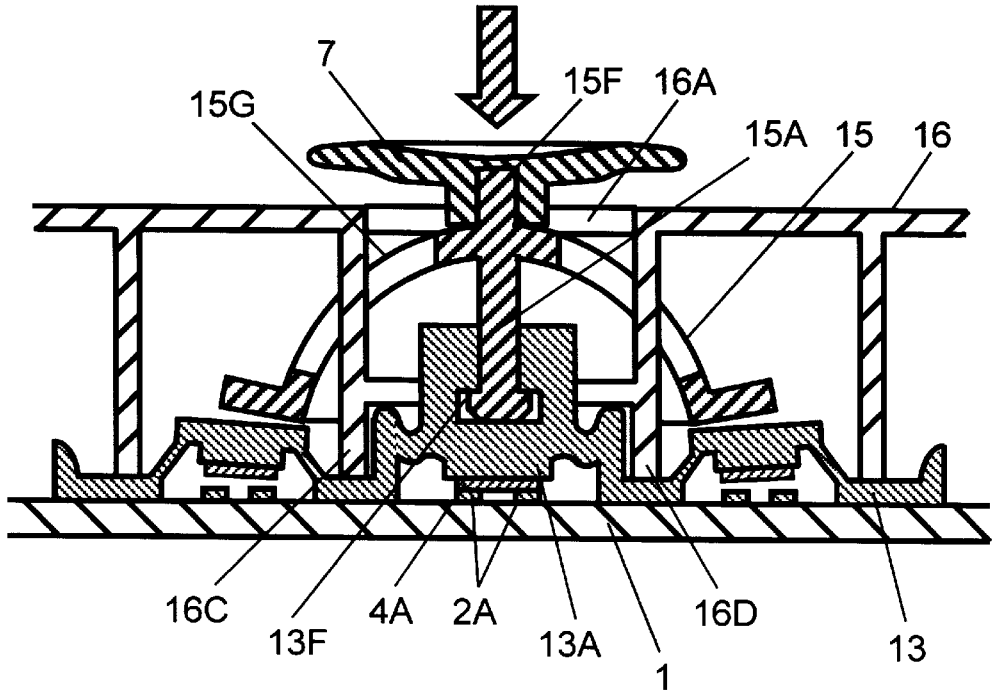
FIG. 2 is a cross sectional view showing the multi-directional operating switch of the first exemplary embodiment while the switch is depressed downward.

In the above structure, when the knob 7 is subjected to a pushing manipulation for vertically downward from the neutral position in FIG. 1, the protuberant part 15A of the manipulation body 15 inserted into the hole 13F of the elastic contactor body 13 depresses and moves the domed portion 13A, and makes an electrical connection by causing the movable contact 4A at the lower surface to contact with the stationary contacts 2A as shown in FIG. 2. When a pushing force of the manipulation to the knob 7 is removed, the movable contact 4A at the lower surface separates from the stationary contacts 2A to disconnect them by the elastic restorative force of the domed portion 13A, and the manipulation body 15 and the knob 7 return to their original neutral positions in FIG. 1.

Figure 3:
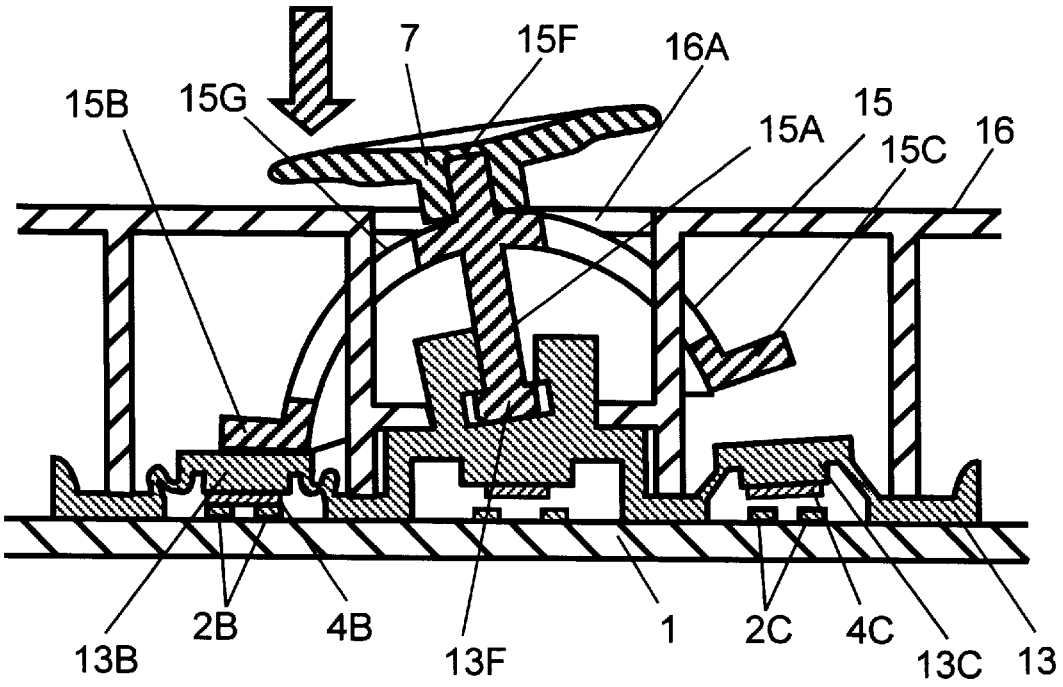
FIG. 3 is a cross sectional view showing the multi-directional operating switch of the first exemplary embodiment while the switch is tilted toward the left.

When the knob 7 is subjected to a tilting manipulation by being pressed at a left edge toward the left as shown in FIG. 3 from the neutral position in FIG. 1, the manipulation body 15 tilts toward the left with a tip of the protuberant part 15A as being a fulcrum, and a depressing limb 15B at a lower left end depresses and moves a domed portion 13B to make an electrical connection by causing the movable contact 4B at the lower surface to contact with the stationary contacts 2B. And, when a force of the tilting manipulation to the left edge of the knob 7 is removed, the movable contact 4B at the lower surface separates from the stationary contacts 2B by the elastic restorative force of the domed portions 13B, and the manipulation body 15 and the knob 7 return to their neutral positions in FIG. 1.

In the same way as the above, if the knob 7 is manipulated for tilting it either rightward, forward or backward from the neutral position of FIG. 1, the manipulation body 15 tilts toward the rightward, forward or backward direction, and a depressing limb 15C at the lower surface depresses and moves a domed portion 13C, thereby making an electrical connection of the stationary contacts 2C by a corresponding movable contact 4C at the lower surface respectively.

As has been described, the present exemplary embodiment is so constructed that a tip of the protuberant part 15A at a lower center surface of the manipulation body 15 is press-fitted into a hole 13F in the upper surface of the domed portion 13A at the center of the elastic contactor body 13, and a predetermined space is provided between the center area 15G at the upper surface.

When the knob 7 is subjected to a tilting manipulation by being pressed at a left edge toward the left as shown in FIG. 3 from the neutral position in FIG. 1, the manipulation body 15 tilts toward the left with a tip of the protuberant part 15A as being a fulcrum, and a depressing limb 15B at a lower left end depresses and moves a domed portion 13B to make an electrical connection by causing the movable contact 4B at the lower surface to contact with the stationary contacts 2B. And, when a force of the tilting manipulation to the left edge of the knob 7 is removed, the movable contact 4B at the lower surface separates from the stationary contacts 2B by the elastic restorative force of the domed portions 13B, and the manipulation body 15 and the knob 7 return to their neutral positions in FIG. 1.

In the same way as the above, if the knob 7 is manipulated for tilting it either rightward, forward or backward from the neutral position of FIG. 1, the manipulation body 15 tilts toward the rightward, forward or backward direction, and a depressing limb 15C at the lower surface depresses and moves a domed portion 13C, downward thereby making an electrical connection of the stationary contacts 2C by a corresponding movable contact 4C at the lower surface respectively.

As has been described, the present exemplary embodiment is so constructed that a tip of the protuberant part 15A at a lower center surface of the manipulation body 15 is press-fitted into a hole 13F in the upper surface of the domed portion 13A at the center of the elastic contactor body 13, and a predetermined space is provided between the center area 15G at the upper surface of the manipulation body 15 and the peripheral wall 16B around the opening 16A of the case 16. The above construction allows the knob 7 to be manipulated without causing the manipulation body 15 to touch with the case 16, thereby realizing at a low cost the multi-directional operating switch having a satisfactory feeling of manipulation without causing friction and without a scraping feeling.

Further, the space provided between the center area 15G at the upper surface of the manipulation body 15 and the peripheral wall 16B around the opening 16A of the case 16 in order to prevent the manipulation body 15 from touching with the case 16 is sheltered by the discus-shaped knob 7 attached to the top center part 15F of the manipulation body 15, so as to maintain a nearly equal level of the outward appearance and dust-tightness as compared to the switches of the prior art.

Furthermore, projections 16C and 16D are provided at a lower position of the case 16 for pressing a periphery of the domed portion 13A of the elastic contactor body 13 against the insulation substrate 1 in order to prevent the domed portion 13A from lifting up when the domed portion 13A makes the movement, thereby attaining a stable and reliable movement of the domed portion 13A and a distinctly good feeling of manipulation.

Although in the described exemplary embodiment, the projections 16C and 16D are provided at a lower position of the case 16 under the opening 16A for pressing a periphery of the domed portion 13A in the center of the elastic contactor body 13, an additional plurality of projections may be provided at a lower surface of the case 16 for also pressing peripheries of the domed portions 13B, 13C of the elastic contactor body 13 by those projections, so that the stable and reliable downward movement and the distinctly good feeling of manipulation are also realized during the tilting manipulation in addition to the pushing manipulation.

If it is not necessary for the peripheries of the domed portions to be pressed by the projections of the case 16 (in such cases as the elastic contactor body 13 is fixed to the insulation substrate 1 with adhesive, etc.), the center area 15G of the manipulation body 15 need not be provided with the openings 15H which the projections 16C and 16D pass through, but only a predetermined space needs to be provided between the manipulation body 15 and the case 16.

SECOND EXEMPLARY EMBODIMENT

Figure 4:
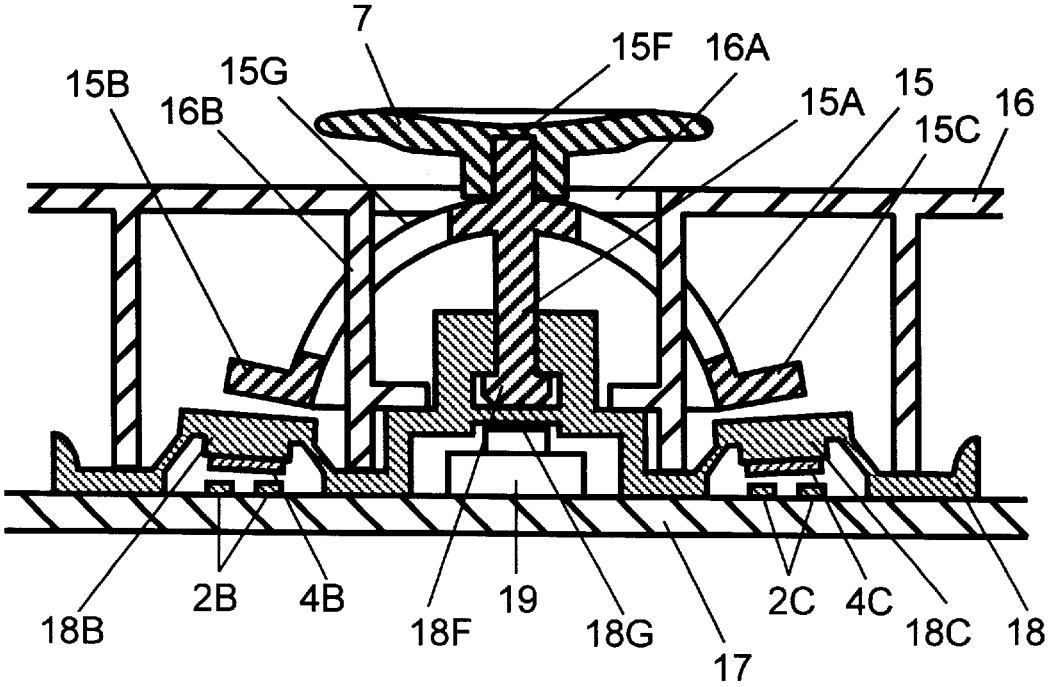
FIG. 4 is a cross sectional view showing a multi-directional operating switch of a second exemplary embodiment of the present invention in its neutral position.
Figure 5:
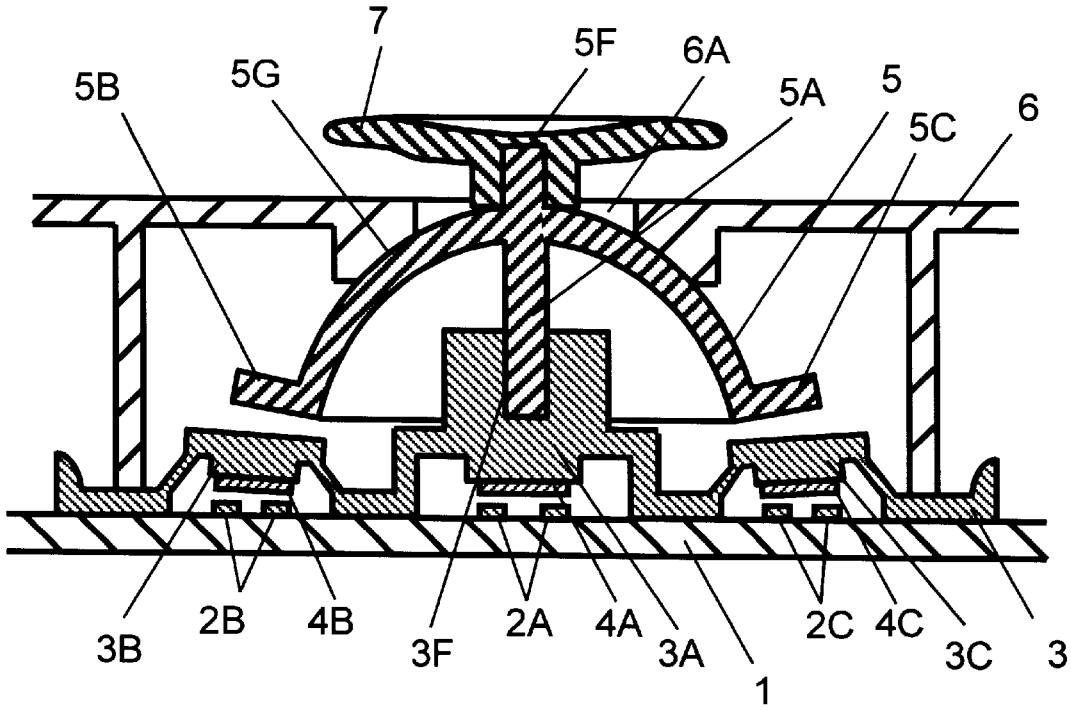
FIG. 5 PRIOR ART
FIG. 5 is a cross sectional view showing a multi-directional operating switch of the prior art in its neutral position.
Figure 6:
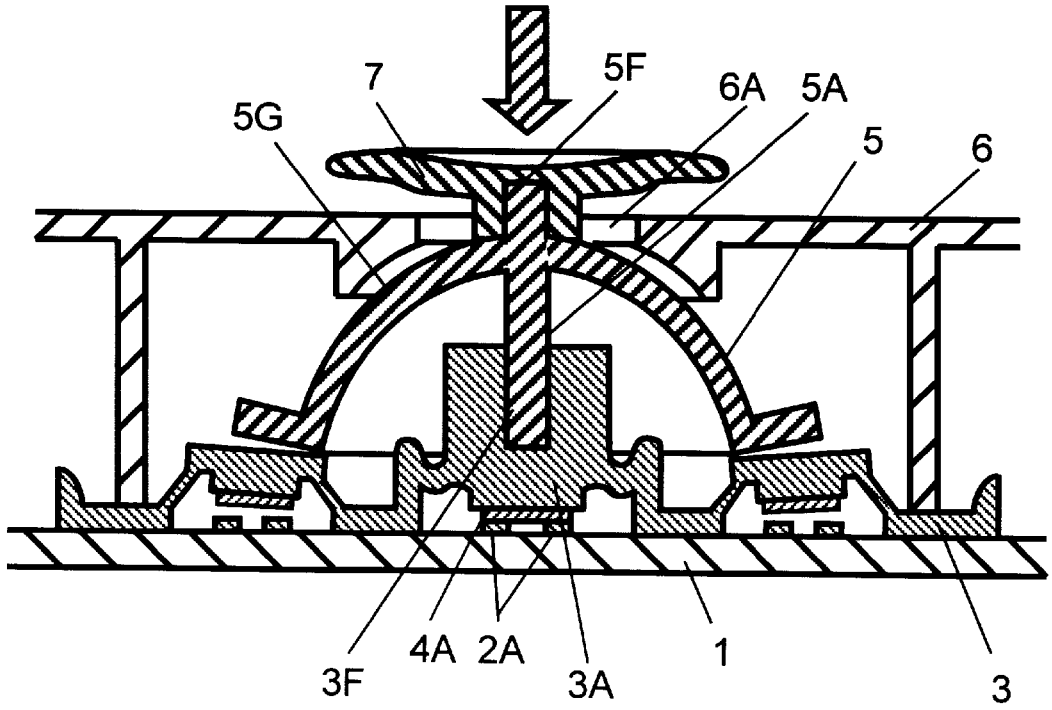
FIG. 6 PRIOR ART
FIG. 6 is a cross sectional view showing the multi-directional operating switch of the prior art when the switch is depressed downward.
Figure 7:
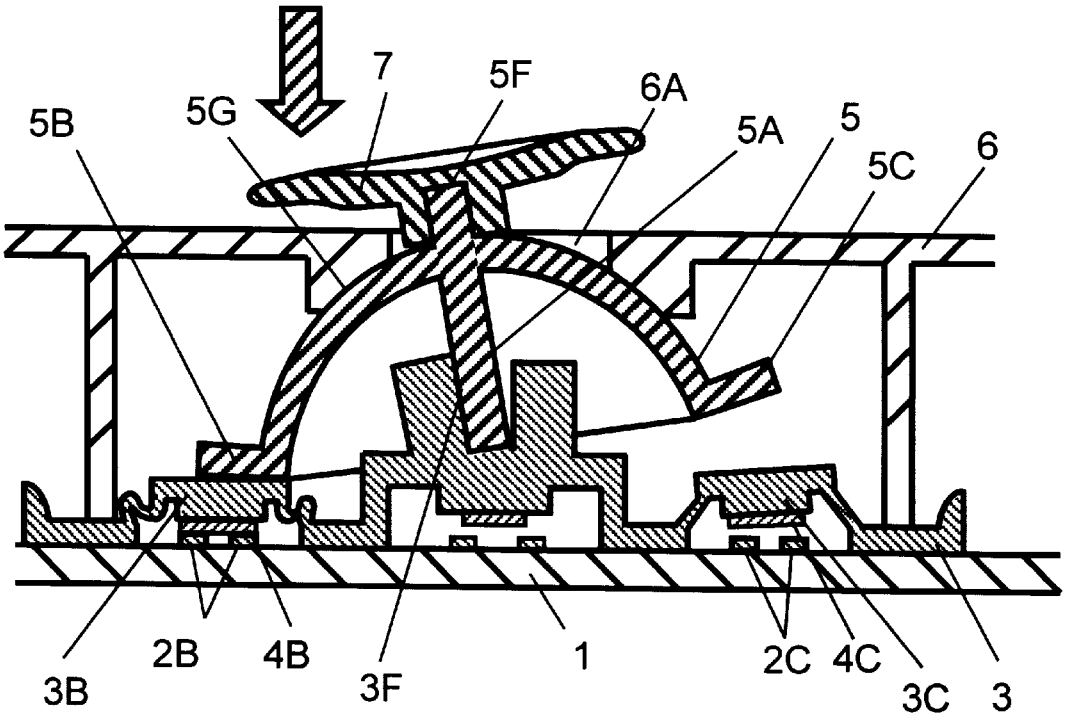
FIG. 7 PRIOR ART
FIG. 7 is a cross sectional view showing the multi-directional operating switch of the prior art while the switch is tilted toward the left.
Figure 8:
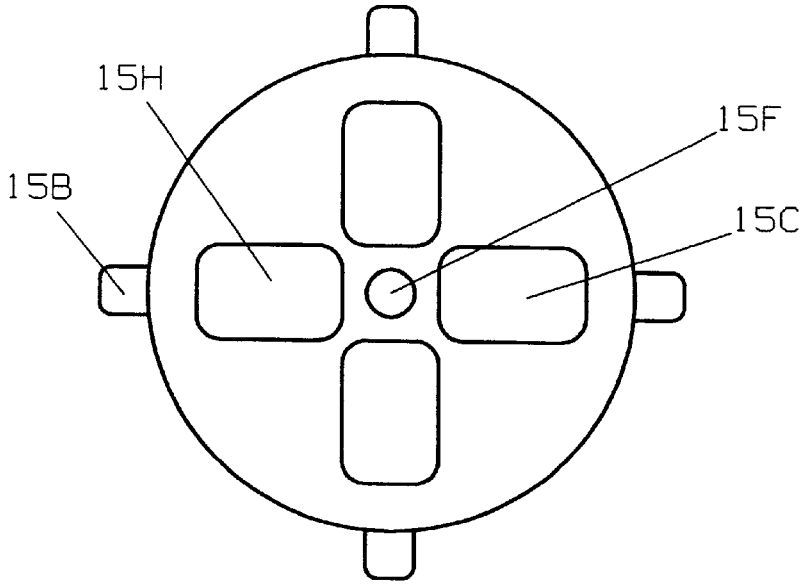
FIG. 8 is a plan view of a manipulation body of the multi-directional operating switch of the first exemplary embodiment of the present invention.
Figure 9:
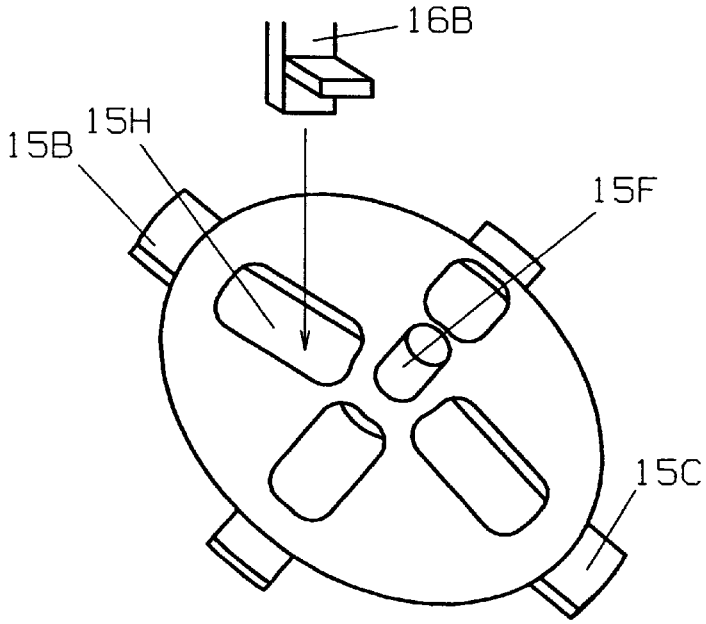
FIG. 9 is a perspective view of the manipulation body and a part of a peripheral wall of a case of the same multi-directional operating switch.
Figure 10:
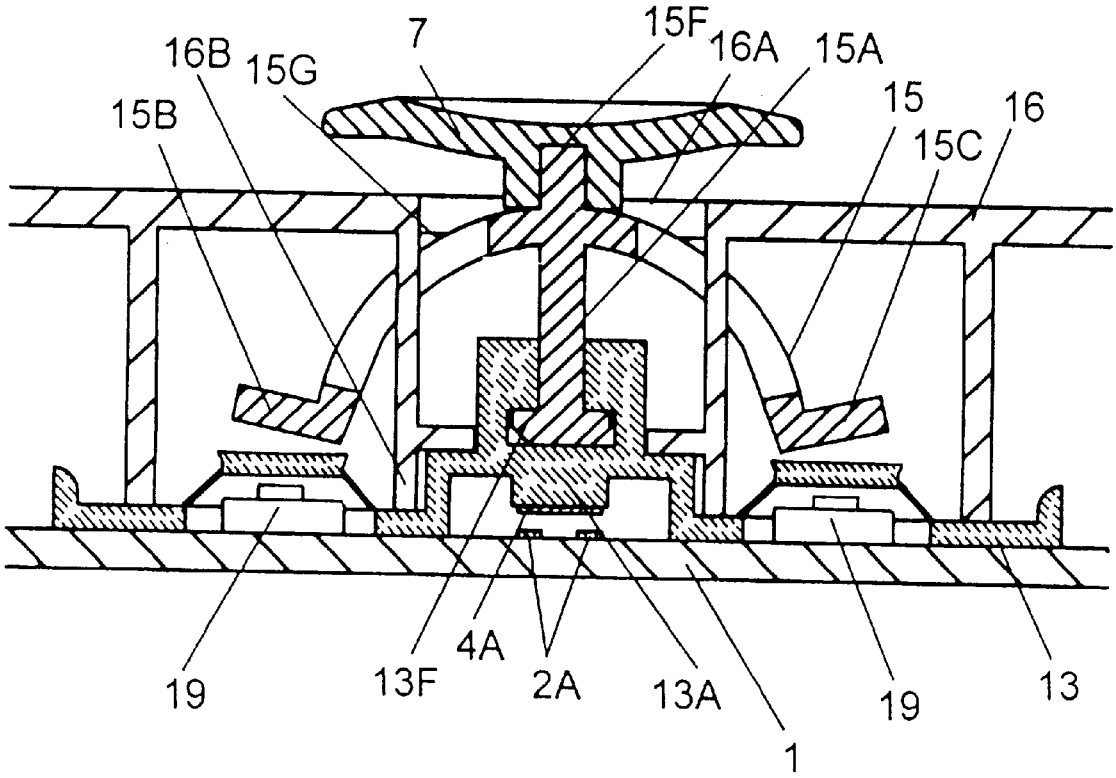
FIG. 10 is a cross sectional view showing another multi-directional operating switch of the second exemplary embodiment of the present invention.
Figure 11:
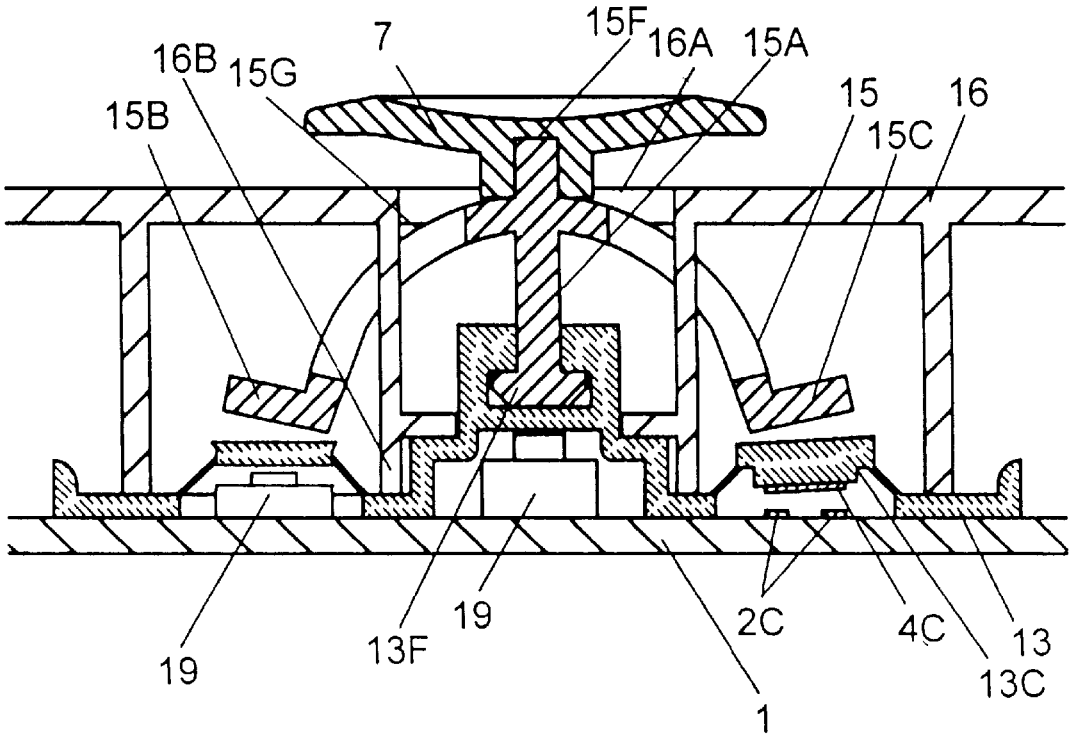
FIG. 11 is a cross sectional view showing still another multi-directional operating switch of the second exemplary embodiment.

A multi-directional operating switch of a second exemplary embodiment of the present invention will be described by referring to FIG. 4.

This exemplary embodiment differs from the first exemplary embodiment with respect to adoption of a self-contained unitary push switch 19 having a click motion in place of the contact at the center portion. That is, the unitary push switch 19 is disposed on an insulation substrate 17 below a lower center surface of an elastic contactor body 18, whereas the other structure remains unchanged from that of the first exemplary embodiment, such as, (a) the elastic contactor body 18 formed at the right, left, front and rear sides of it with domed portions 18B, 18C (others not shown) is disposed above the insulation substrate 17 employing plural pairs of stationary contacts 2B, 2C on the upper surface, (b) a manipulation body 15 is provided at the right, left, front and rear sides of its lower surface with depressing limbs 15B, 15C, and (c) a predetermined space is provided between a semispherical center area 15G at an upper surface of the manipulation body 15 and the peripheral wall 16B around the opening 16A of the case 16.

A tip of a protuberant part 15A at the lower center surface of the manipulation body 15 is press-fitted into a deep of the hole 18F in the upper center surface of the elastic contactor body 18 in such a manner that the manipulation body 15 is held by the elastic contactor body 18 for being movable in up and down motion as well as in tilting motion, and a lower center surface of the elastic contactor body 18 is provided with a depressing face 18G for activating the push switch 19.

In the above structure, when the knob 7 is subjected to a pushing manipulation by pushing it vertically downward, the depressing surface 18G on the lower center surface of the elastic contactor body 18 depresses the push switch 19 to make and break an electrical connection of the push switch, whereas it also operates identically as in the case of the first exemplary embodiment in a such way that when the knob 7 is manipulated by tilting it toward either the rightward, leftward, forward or backward direction, the manipulation body 15 tilts with a tip of the protuberant part 15A as being a fulcrum, and a depressing limb 15B, 15C at the lower surface depresses and moves a domed portion 18B, 18C downward.

As has been described, since the present exemplary embodiment causes a movement of the domed portions 18B, 18C of the elastic contactor body 18 when a tilting manipulation is made, and operates the push switch 19 with the depressing face 18G of the elastic contactor body 18 when a pushing manipulation is made, whereby achieving a different feel between the tilting manipulation and the pushing manipulation. Also, since the present exemplary embodiment enables various kinds of push switch having different number of circuits, operating force, etc. to be disposable without requiring any alteration of other parts, a multi-directional operating switch having numerous operational functions is easily obtainable.

Although in the above-described structure, the push switch 19 is arranged under the lower center surface of the elastic contactor body 18, this is not exclusive and push switches can be arranged at both the right and the left sides, or at the forward and the backward sides, or at either side of them, so that a different feel of the tilting manipulation toward right-to-left, forward-to-backward and the pushing manipulation can be attained.

Accordingly, the present invention gives a favorable effect for realizing the multi-directional operating switch having a good feeling of manipulation at a low cost.

What is claimed is:

1. A multi-directional operating switch comprising:

(a) an insulation substrate employing a plurality of stationary contacts on an upper surface thereof;

(b) an elastic contactor body disposed on top of said insulation substrate and having a plurality of peripheral domed portions arranged around a central domed portion, wherein at least one of 1) at least one peripheral domed portion of the plurality of peripheral domed portions and 2) the central domed portion is provided with a movable contact that confronts a corresponding one of said stationary contacts, and wherein said central domed portion has a hole in an upper surface;

(c) a manipulation body, of which a tip of a protuberant part at a lower center surface is press-fitted into said hole in the upper surface of said central domed portion of said elastic contactor body, and having a plurality of depressing limbs around a lower peripheral surface for depressing said peripheral domed portions at an outer periphery of said elastic contactor body when tilted;

(d) a case having a top central opening for an upper center part of said manipulation body to pass there through, and for partially covering an upper surface of said manipulation body while maintaining a predetermined space in order to avoid said case from touching with said manipulation body around said top central opening at a lower surface of said case when said manipulation body is in a neutral position and when said manipulation body is tilted; and (e) a plate shaped knob mounted on a top center part of said manipulation body, wherein said knob covers a substantial portion of an upper area of said opening of said case.

2. The multi-directional operating switch according to claim 1 wherein at least one unitary push switch is disposed on said insulation substrate, and a depressing face is provided on a lower surface of at least one of 1) the central domed portion and 2) at least one peripheral domed portion of the plurality of peripheral domed portions of said elastic contactor body that confronts said push switch.

3. The multi-directional operating switch according to claim 1 further comprising a projection on the lower surface of said case, said projection extending from said lower surface to the elastic contactor body, wherein said elastic contactor body is pressed against said insulation substrate with said projection at a location between said central domed portion and said periphery domed portions.

4. The multi-directional operating switch according to claim 3 wherein at least one unitary push switch is disposed on said insulation substrate, and a depressing face is provided on a lower surface of at least one of 1) the central domed portion and 2) at least one peripheral domed portion of the plurality of peripheral domed portions of said elastic contactor body that confronts said push switch.

5. The multi-directional operating switch according to claim 3 wherein said manipulation body includes an opening, and said projection on the lower surface of said case passes through said opening in said manipulation body.

* * * * *